US008650918B2

(12) United States Patent
McMaster et al.

(10) Patent No.: US 8,650,918 B2
(45) Date of Patent: Feb. 18, 2014

(54) BASKET ASSEMBLY FOR A WASHING MACHINE

(75) Inventors: William J. McMaster, Berkeley Heights, NJ (US); Stephen P. Serna, Hopatcong, NJ (US); Gavin L. Jewell, Chicago, IL (US)

(73) Assignee: BASF SE, Ludwigshafen (DE)

( * ) Notice: Subject to any disclaimer, the term of this patent is extended or adjusted under 35 U.S.C. 154(b) by 1108 days.

(21) Appl. No.: 12/344,357

(22) Filed: Dec. 26, 2008

(65) Prior Publication Data

US 2009/0211311 A1 Aug. 27, 2009

Related U.S. Application Data

(63) Continuation-in-part of application No. PCT/EP2008/058013, filed on Jun. 24, 2008.

(60) Provisional application No. 60/947,170, filed on Jun. 29, 2007.

(51) Int. Cl.
*D06F 37/20* (2006.01)

(52) U.S. Cl.
USPC ..... 68/140

(58) Field of Classification Search
USPC ..... 68/140
See application file for complete search history.

(56) References Cited

U.S. PATENT DOCUMENTS 3,307,383 A 3/1967 Cobb et al.
3,548,617 A 12/1970 Wasemann
3,626,728 A 12/1971 Traube et al.
3,772,925 A 11/1973 Sisson
3,958,433 A 5/1976 Bochan
4,216,663 A 8/1980 Shacklock
4,328,600 A 5/1982 Bochan
5,019,450 A * 5/1991 Cogswell et al. ..... 428/402
5,297,403 A 3/1994 Farrington et al.
5,373,715 A 12/1994 Sharp et al.
5,746,070 A 5/1998 Bailey et al.

(Continued)

FOREIGN PATENT DOCUMENTS

DE 1236457 B 3/1967
EP 1506333 B1 2/2005

(Continued)

OTHER PUBLICATIONS

English version of KR20070042832.*

(Continued)

*Primary Examiner* — Michael Barr
*Assistant Examiner* — Jason Riggleman
(74) *Attorney, Agent, or Firm* — Howard & Howard Attorneys PLLC

(57) ABSTRACT

A basket assembly for a washing machine includes a basket and a bracket attached to the basket. A motor is coupled to the bracket and the bracket transmits rotation from the motor to the basket. The support bracket is formed of a thermoplastic and includes a hub and fins spaced from each other extending radially from the hub. Each of the fins has an attachment portion connected to the basket. The support bracket includes a reinforcement rod spaced from the hub extending from one of the fins to another of the fins for reinforcing the fins when the support bracket transmits rotation from the motor to the basket.

12 Claims, 10 Drawing Sheets

(56) References Cited

U.S. PATENT DOCUMENTS

| | | | | |
|---|---|---|---|---|
| 5,784,902 | A | 7/1998 | Pinkowski et al. | |
| 6,918,271 | B2 | 7/2005 | Lim et al. | |
| 2005/0103060 | A1* | 5/2005 | Ozturk et al. | 68/3 R |
| 2005/0252252 | A1 | 11/2005 | Lee et al. | |
| 2007/0289341 | A1* | 12/2007 | Hollenhorst et al. | 68/275 |
| 2008/0178635 | A1* | 7/2008 | Ratfisch | 68/140 |

FOREIGN PATENT DOCUMENTS

| | | | | |
|---|---|---|---|---|
| WO | 03080915 | A2 | 10/2003 | |
| WO | WO2006126814 | A2 * | 5/2006 | D06F 37/04 |
| WO | 2009003875 | A1 | 1/2009 | |

OTHER PUBLICATIONS

English version of KR1020050012392.*

International Search Report for Application No. PCT/EP2008/058013, dated Nov. 21, 2008, 2 pages.

Repair Manual for Duet Sport™ Front-Loading Automatic Washer, 2006, Whirlpool Corporation, Benton Harbor, MI, pp. i, ii, 4-1, and 4-28 through 4-32.

* cited by examiner

BASKET ASSEMBLY FOR A WASHING MACHINE

CROSS-REFERENCE TO RELATED APPLICATIONS

This patent application is a Continuation-In-Part of and claims priority to and all advantages of International Application PCT/EP2008/058013 filed on Jun. 24, 2008 under the Patent Cooperation Treaty, which claims priority to and all advantages of U.S. Provisional Patent Application No. 60/947,170 filed on Jun. 29, 2007.

BACKGROUND OF THE INVENTION

1. Field of the Invention

The present invention generally relates to a basket assembly for a washing machine and particularly a basket and support bracket of the basket assembly.

2. Description of the Related Art

Washing machines include a basket assembly for receiving materials to be washed. The basket assembly is rotatable to agitate such materials and the rotation of the basket assembly results in stress in the basket assembly.

The washing machine includes a tub that receives a supply of wash liquid. The tub is hollow and the basket assembly is disposed in the tub. The basket assembly includes a basket that is hollow and permeable to receive the wash liquid. The basket extends between a first end and a second end. The first end is open for receiving laundry. An end wall is attached to the second end of the basket for enclosing the second end. A support bracket is mounted to the second end of the basket adjacent to the back plate. A motor is coupled to the bracket to rotate the support bracket thereby rotating the basket.

The support bracket is formed of metal to withstand the stresses resulting from the rotation of the support bracket. The metal is a relatively expensive material and is subject to corrosion from contact with the wash liquid.

Accordingly, it would be advantageous to design a basket assembly for a washing machine that comprises less expensive and more corrosion resistant components such that the basket assembly is more durable while remaining more cost effective from a material/manufacturing standpoint.

SUMMARY OF THE INVENTION AND ADVANTAGES

A basket assembly for a washing machine comprises a basket having an axis and a first end and a second end spaced along the axis. The basket defines a cavity at the first end of the basket for receiving laundry and has an end wall at the second end of the basket extending transverse to the axis with the end wall of the basket defining a depression. A support bracket for transmitting rotation from a motor to the basket is disposed in the depression and is formed of a thermoplastic. The support bracket includes a hub and fins spaced from each other extending radially from the hub. Each of the fins has an attachment portion connected to the basket at the second end of the basket. The support bracket includes a reinforcement rod spaced from the hub extending from one of the fins to another of the fins for reinforcing the fins when the support bracket transmits rotation from the motor to the basket.

The thermoplastic material of the support bracket is advantageously inexpensive and lightweight compared to the metal used in the prior art. In addition, the design of the support bracket, e.g., with the fins, hub, and reinforcement rod, enables the support bracket to withstand the high loads that the support bracket is subjected to during the transmission of rotation from the motor to the basket. In other words, the support bracket is designed to withstand these high loads with an inexpensive, lightweight material and with less of that material. As such, the cost to produce the support bracket is minimized while maintaining the performance capability of the support bracket.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

Referring to the Figures, wherein like numerals indicate corresponding parts throughout the several views, a basket assembly 24, 124 for a washing machine 20, e.g., a washing machine for washing laundry, is generally shown. Specifically, a first embodiment of the basket assembly 24 is shown in FIGS. 1-5B and a second embodiment of the basket assembly 124 is shown in FIGS. 6A-9B. The washing machine 20 is also referred to in industry as an automatic washer.

Figure 1:
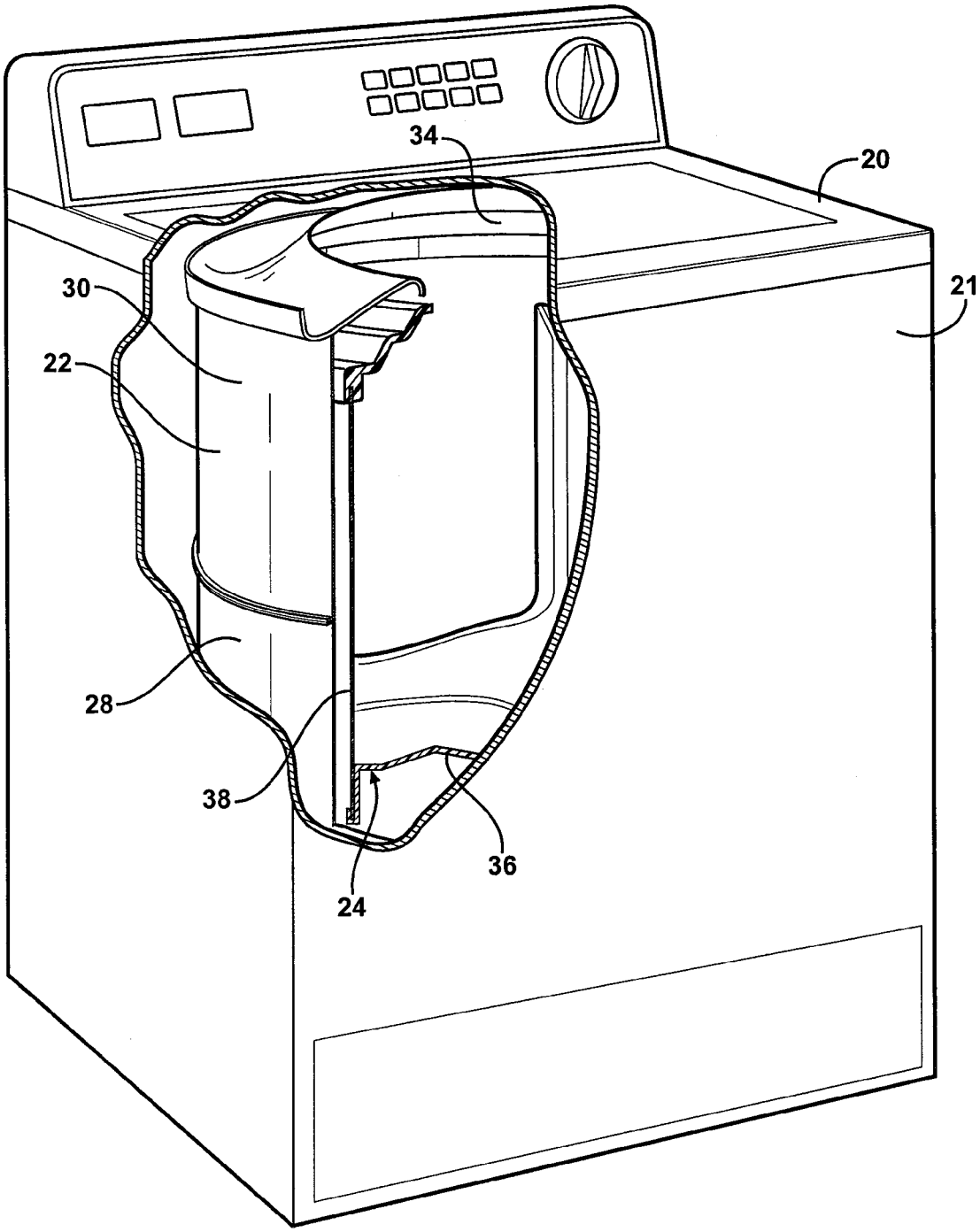
FIG. 1 is a cut-away perspective view of a washing machine including a basket assembly.
Figure 2:
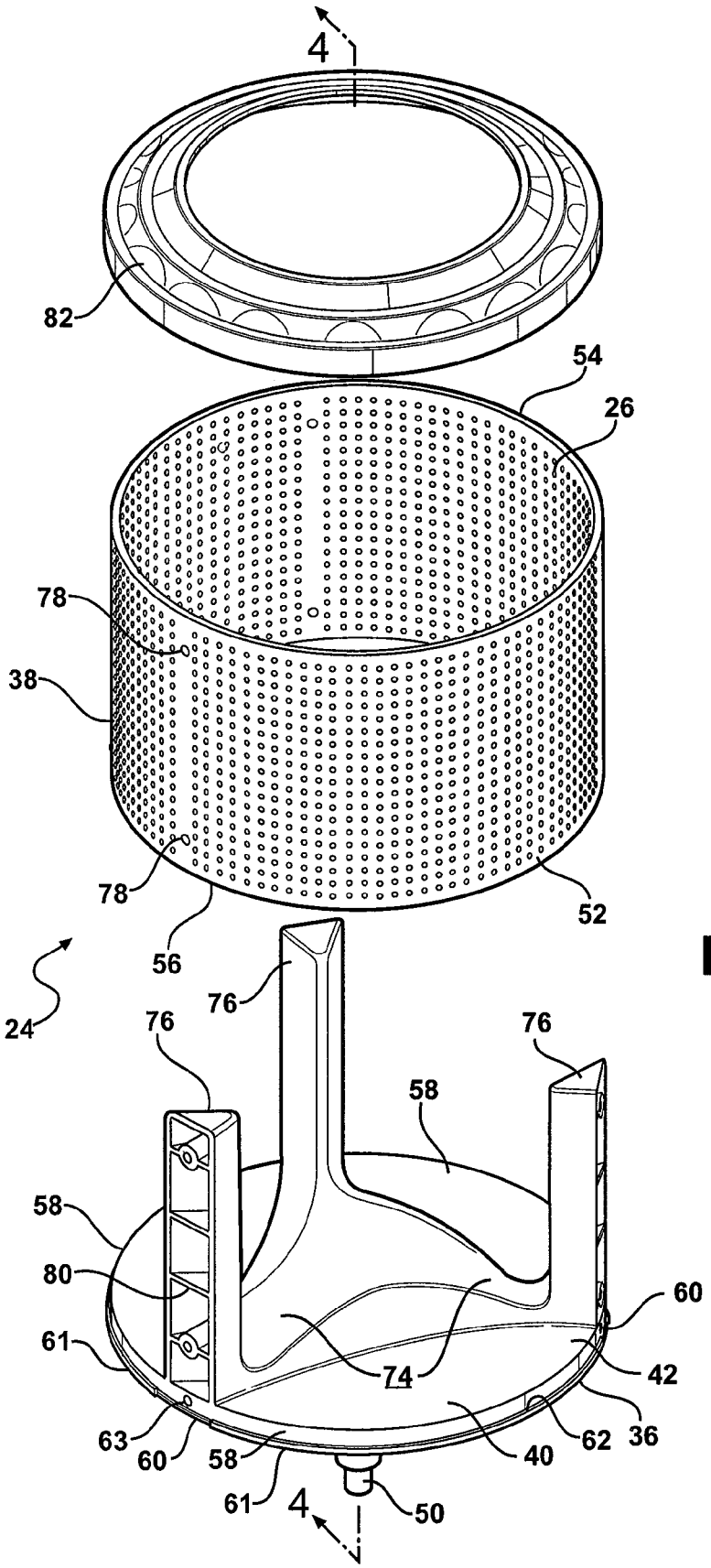
FIG. 2 is an exploded view of the basket assembly.

As shown in FIG. 1, the washing machine 20 includes a cabinet 21 and a tub 22 disposed within the cabinet 21. It should also be appreciated that the washing machine 20 is not limited to a top-load unit as shown in FIG. 1 and could have a different configuration, e.g., a front-load unit, without departing from the nature of the present invention. The first embodiment of the basket assembly 24 is shown in the cabinet 21 in FIG. 1 and it should be appreciated that alternatively, although not shown in the Figures, the second embodiment of the basket assembly 124 can be disposed in the cabinet 21 in the same manner as the first embodiment of the basket assembly 24.

The tub 22 receives a supply of wash liquid, e.g., laundry detergent and water. The cabinet 21 includes a lid which is opened to access the tub 22 and which is closed to enclose the tub 22 within the cabinet 21.

The basket assembly 24, 124 is partially disposed within the tub 22. The basket assembly 24, 124 includes a support bracket 36, 136 and a basket 38, 138 coupled to the support bracket 36, 136. The basket 38, 138 is hollow and receives a load of materials to be washed, e.g., laundry. The basket 38, 138 is also referred to in industry as a wash basket.

The basket 38, 138 has an axis A and a first end 54 and a second end 56 spaced along the axis A. The basket 38, 138 includes a cylindrical wall 52 extending between the first end 54 and the second end 56. The basket 38, 138 defines a cavity 26 at the first end 54 for receiving laundry. The basket 38, 138 is permeable, i.e., the cavity 26 is in fluid communication with the tub 22. As set forth further below, in the first embodiment, the cavity 26 typically extends through the first end 54 and the second end 56, i.e., the basket 38 is open at both the first and second ends 54, 56. In the second embodiment, the basket 138 typically includes an end wall at said second end 56 of the basket 138 extending transverse to the axis A. The basket 38 is typically cylindrical.

A motor (not shown) is typically disposed below the basket assembly 24, 124 and is coupled to the support bracket 36, 136. The motor rotates and/or oscillates the basket assembly 24, 124 relative to the tub 22 to agitate the laundry and the wash liquid in the basket assembly 24, 124.

The basket assembly 24, 124 may include an agitator (not shown), e.g., an auger extending into the cavity 26 of the basket 38, 138. The basket assembly 24, 124 includes a front ring 82 mounted to the second end 56 of the basket 38, 138. The front ring 82 is attached to the basket 38, 138 with, for example, rivets or threaded fasteners and/or is welded to the basket 38, 138.

As shown in FIG. 1, the tub 22 includes a first tub half 28 and a second tub half 30 attached to the first tub half 28. The first and second tub halves 28, 30 are typically cylindrical in shape and are hollow to receive the basket assembly 24, 124 between the first and second tub halves 28, 30. The second tub half 30 defines an opening 34 and the lid is hinged to the second tub half 30 near the opening 34. The lid is opened to expose the opening 34 and is closed to enclose the opening 34. It should be appreciated that the tub 22 is described herein for exemplary purposes and the tub 22 can have any suitable configuration without departing from the nature of the present invention.

The basket assembly 24, 124 is aligned in the tub 22 such that the cavity 26 of the basket assembly 24, 124 is aligned with the opening 34 of the second tub half 30. As such, materials to be washed are loaded through the opening 34 of the second tub half 30 and into the cavity 26 of the basket 38, 138 when the lid is opened. The lid is typically closed for the washing process.

The support bracket 36, 136 includes a sleeve portion 46. In the first embodiment, the sleeve portion 46 integrally extends from a base 40 of the support bracket 36. Throughout this specification, the term "integral" is used to refer to elements that together form a single continuous piece of material such as for example, by molding, welding, fusing, casting, etc. In the second embodiment, the sleeve portion 46 integrally extends from a hub 88 of the support bracket 136. It should be appreciated that the sleeve portion 46 may be formed as a separate piece and subsequently attached to the base 40 or the hub 88, for example, adhesive, melt bonding, or mechanical fastening without departing from the nature of the present invention.

The sleeve portion 46 defines a bore 48 and a drive rod 50 is mounted in and extends from the bore 48. The drive rod 50 extends through a through-hole of the first tub half 28 and engages the motor of the washing machine. Alternatively, the drive rod 50 is coupled to the motor with, for example, a system including at least one belt and pulley. In the first embodiment, the combination of the sleeve portion 46 and the base 40 distributes the stress on the support bracket 36 allowing the support bracket 36 to survive high loads resulting from the rotation of the drive rod 50. The base 40 of the support bracket 36 is designed with a sufficient depth such that the support bracket 36 can survive such high loads. Likewise, in the second embodiment, the combination of the sleeve portion 46 and the hub 88 distributes the stress on the support bracket 136 allowing the support bracket 136 to survive high loads resulting from the rotation of the drive rod 50. The hub 88 of the support bracket 136 is designed with a sufficient depth such that the support bracket 136 can survive such high loads. In any event, the drive rod 50 is fixed to the base 40/hub 88 for coupling the support bracket 36, 136 to the motor.

The drive rod 50 is press fit into the bore 48 of the sleeve portion 46. Alternatively, the drive rod 50 is insert molded with the sleeve portion 46. The insert molding process includes placing the drive rod 50 in a plastic injection mold and subsequently injecting the molten plastic into the mold about a portion of the drive rod 50. In any event, the drive rod 50 is engaged in the bore 48 of the sleeve portion 46 and the drive rod 50 and the sleeve portion 46 are immoveable relative to each other.

Figure 7:
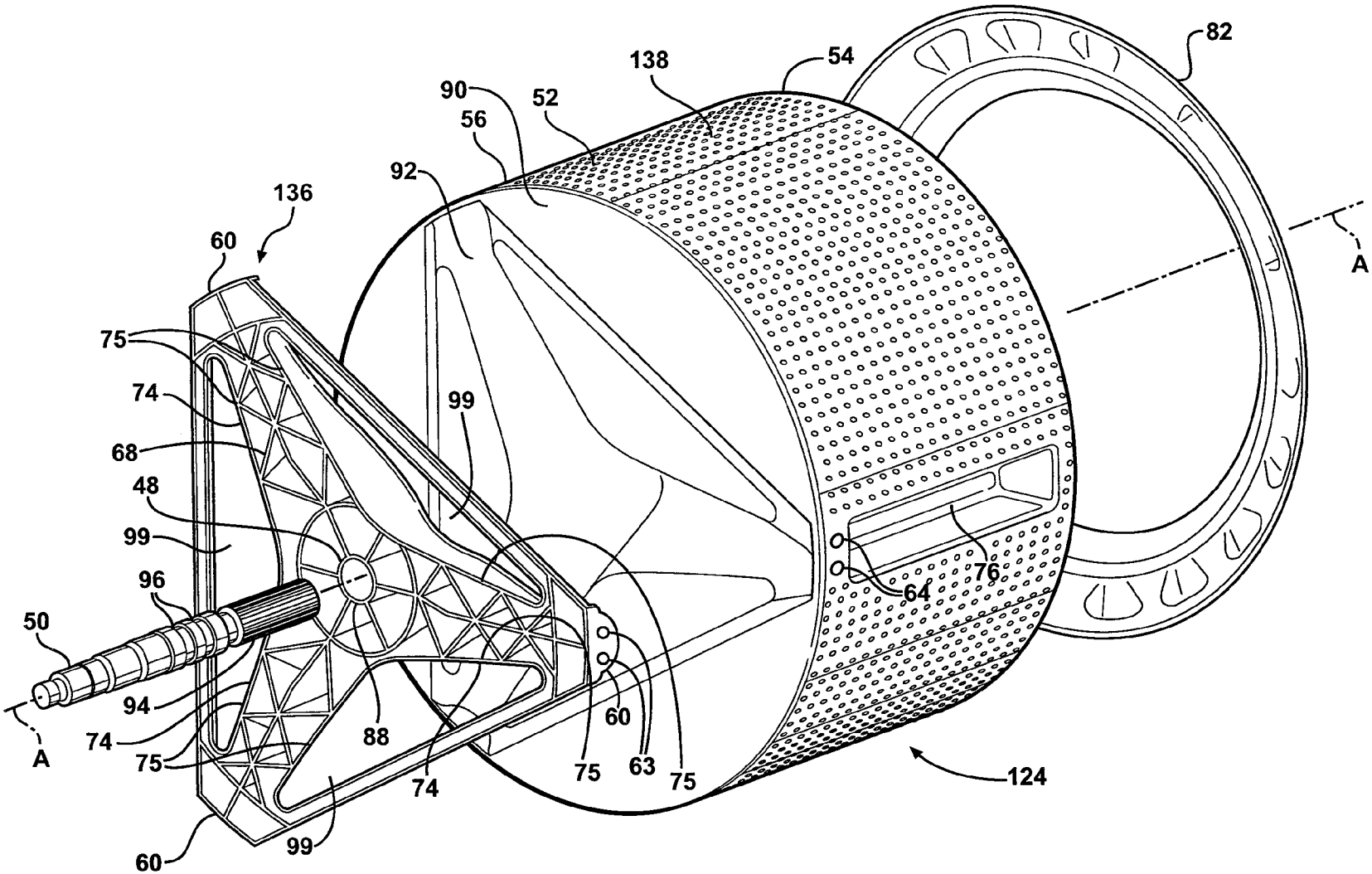
FIG. 7 is an exploded view of the second embodiment of the basket assembly.
Figure 8:
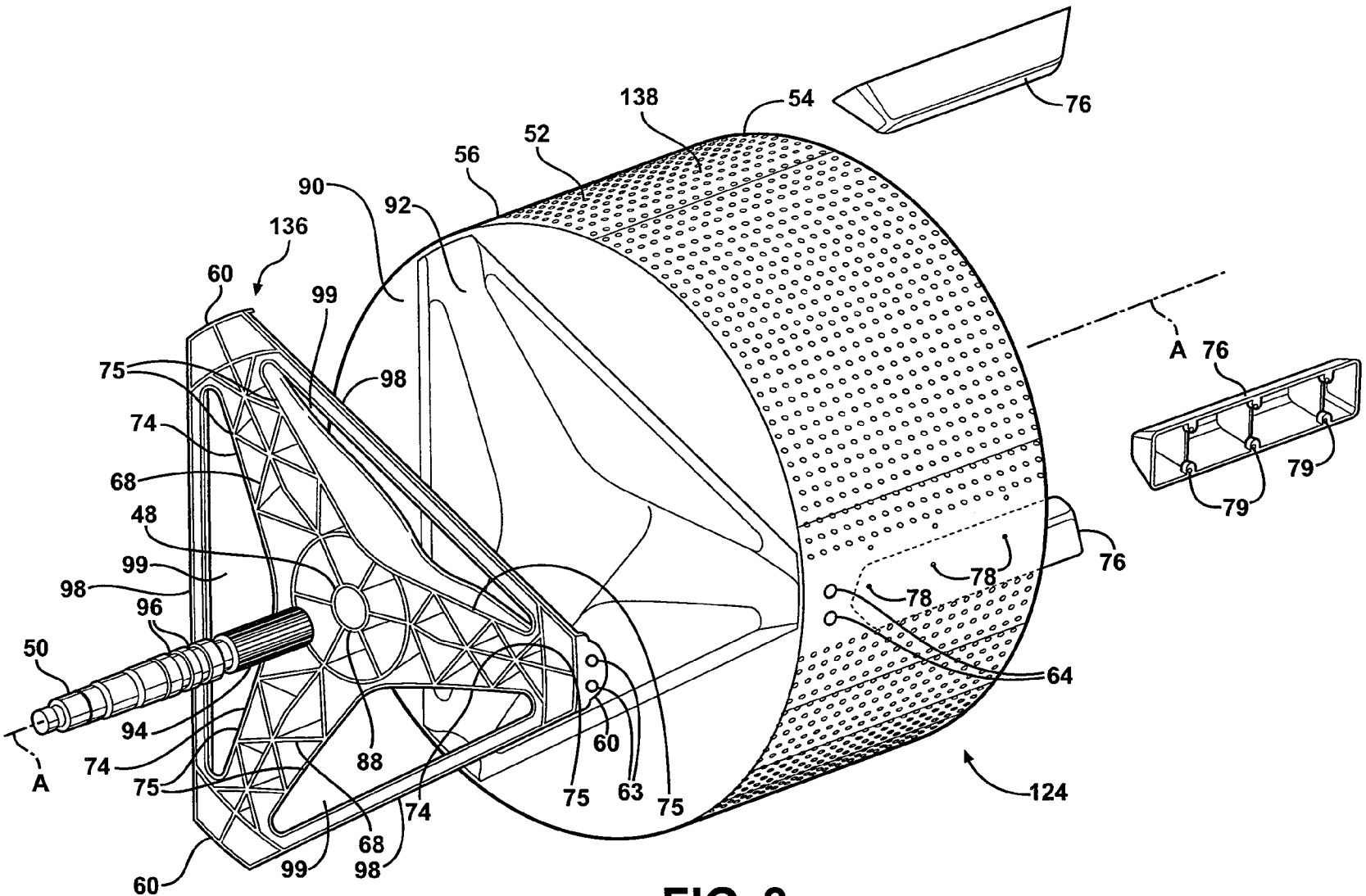
FIG. 8 is another exploded view of the second embodiment of the basket assembly.
Figure 9A:
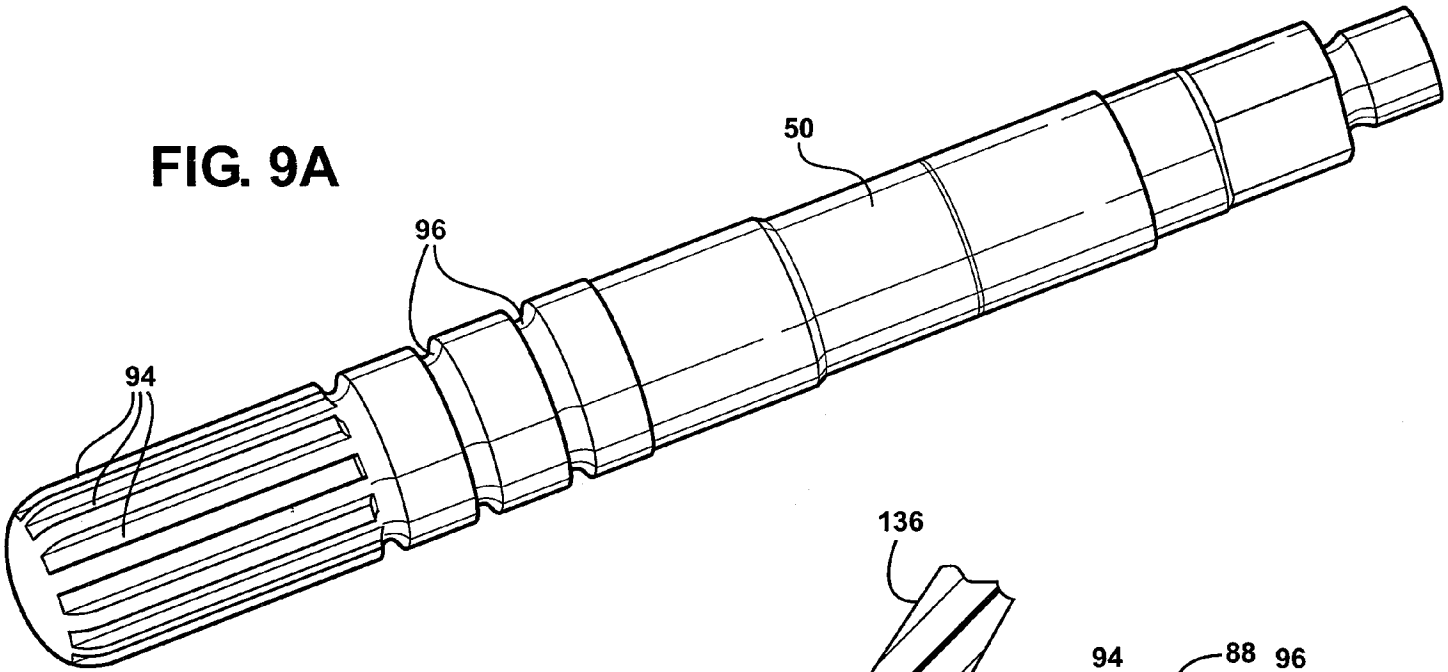
FIG. 9A is a perspective view of a shaft that engages the support bracket.
Figure 9B:
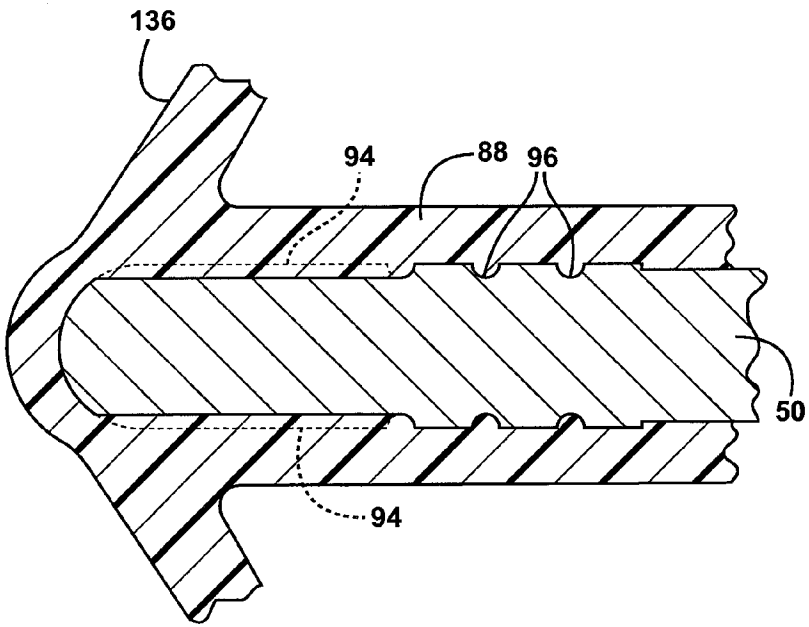
FIG. 9B is a perspective view of the shaft of FIG. 9A.

As shown in FIGS. 9A-9B, the drive rod 50 can define longitudinal grooves 94 and circumferential grooves 96 for fixing the drive rod 50 to the support bracket 36, 136. The longitudinal grooves 94 extend along the axis A and are commonly referred to in industry as splines. The support bracket 36, 136 engages the longitudinal grooves 94 to rotationally fix the support bracket 36, 136 to the drive rod 50 such that the drive rod 50 can transmit rotation to the support bracket 36, 136. The support bracket 36, 136 engages the circumferential grooves 96 to axially fix the support bracket 36, 136 to the drive rod 50. As set forth above, the support bracket 36, 136 is typically insert molded with the drive rod 50 to engage the longitudinal grooves 94 and the circumferential grooves 96. It should be appreciated that the drive rod 50 is shown in an exploded view in FIGS. 7 and 8 merely for exemplary purposes and that the drive rod 50 shown in FIGS. 7 and 8 is typically fixed to the support bracket 36, 136 after the support bracket 36, 136 is formed. It should also be appreciated that the drive rod 50 can have any configuration to engage the support bracket such as, for example, flats, protrusions, etc.

The support bracket 36, 136 is formed from a plastic material and specifically a thermoplastic material. Specifically, the support bracket 36, 136 is formed from polyalkylene terephthalate such as polybutylene terephthalate (PBT). The polyalkylene terephthalate can be reinforced with fiber such as, for example, glass fibers. When reinforced with glass, the polyalkylene terephthalate typically comprises 30%-50% glass content. An example of a fiber reinforced PBT suitable for the support bracket 36 are those which are commercially available from BASF Corporation in Florham Park, N.J. under the tradenames Ultradur® B4330 G6 HR or Ultradur® B4330 G10 HR. Another example of a fiber reinforced PBT suitable for the support bracket 36 are those which are commercially available from BASF Corporation under the tradenames Ultradur® B4040 G6 HR or Ultradur® B4040 G10 HR. It should be appreciated that the support bracket 36 may be formed from any type of suitable plastic material without departing from the nature of the present invention. In any event, the material of the support bracket 36, 138 is preferably hydrolysis resistant. The support bracket 36, 136 is typically formed by plastic injection molding.

Typically, the basket 38, 138 is formed of a plastic material or metal. An example of such a plastic material is a second thermoplastic. This second thermoplastic could be the same as or different than the thermoplastic of the support bracket 36, 136. One such example of this second thermoplastic is polypropylene. Alternatively, when formed of metal, the basket 38, 138 can, for example, be formed of aluminum, stainless steel, or a combination of aluminum and stainless steel components.

The first embodiment of the basket assembly 24 is described in greater detail immediately below. As best shown in FIGS. 2-5B, the support bracket 36 includes a base 40. The base 40 typically has a cylindrical perimeter and presents a front side 42 facing the basket 38 and a back side 44 facing the first tub half 28. It should be appreciated that the perimeter of the base 40 typically abuts the basket 38 such that the perimeter of the base 40 is shaped correspondingly to the basket 38. As set forth below, the support bracket 36 is typically formed as a one-piece unit, i.e., all features of the support bracket 36 are integral. It should be appreciated that the support bracket 36 could be formed of individual parts subsequently attached together.

Figure 3:
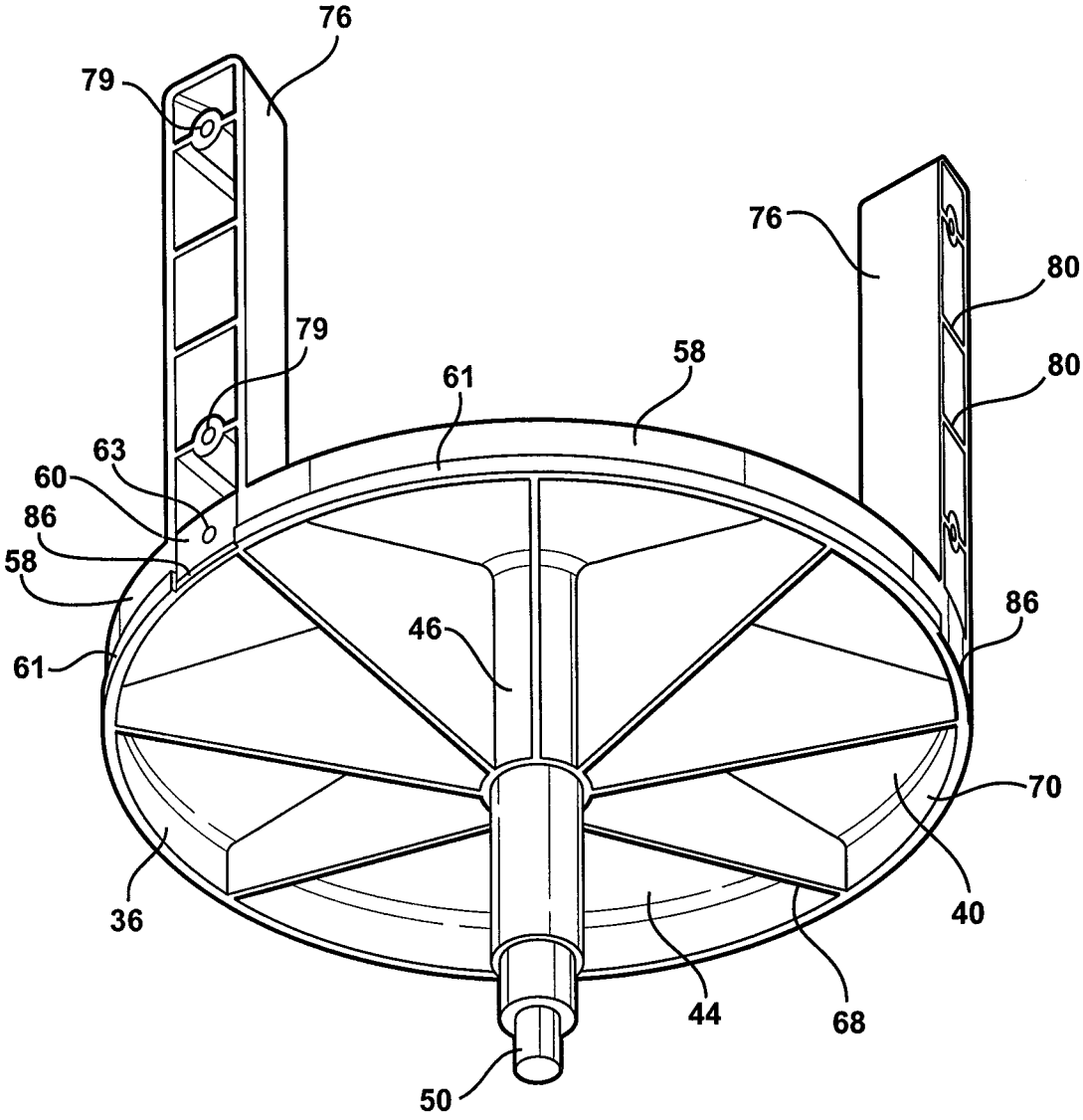
FIG. 3 is a perspective view of a support bracket of the basket assembly.
Figure 5A:
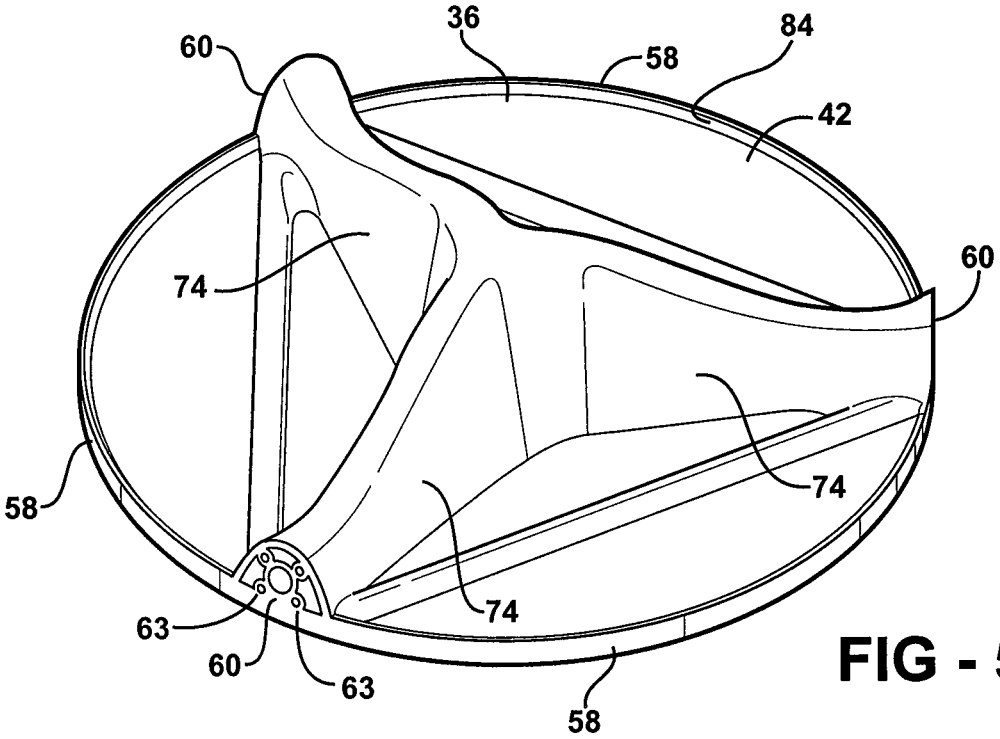
FIG. 5A is a perspective view of the support bracket.

As best shown in FIGS. 3 and 5A, the support bracket 36 includes a plurality of ribs 68 extending from the back side 44 of the base 40. In the embodiment shown in FIG. 3, the support bracket 36 includes a lip 70 extending around the perimeter of the base 40 and the ribs 68 are attached to the lip 70. The ribs 68 increase the strength and the stiffness of the support bracket 36. The base 40, the ribs 68, and the lip 70 are integral with each other. It should be appreciated that the base 40, the ribs 68, and the lip 70 may be formed as separate pieces and subsequently attached to each other by, for example, adhesive, melt bonding, or mechanical fastening without departing from the nature of the present invention.

As shown in FIGS. 2-4C, the support bracket 36 includes a plurality of attachment portions 60 and a plurality of intermediate portions 58. Each attachment portion 60 extends from the front side 42 of the base 40 and the attachment portions 60 are spaced from each other radially relative to the axis A. Each of the intermediate portions 58 extend from the front side 42 and are spaced from each other radially relative to the axis in alternating arrangement with the attachment portions 60. In the embodiments shown in the Figures, the support bracket 36 has three attachment portions 60 and three intermediate portions 58; however, it should be appreciated that the support bracket 36 can have any number of attachment portions 60 and intermediate portions 58 without departing from the nature of the present invention.

Figure 4A:
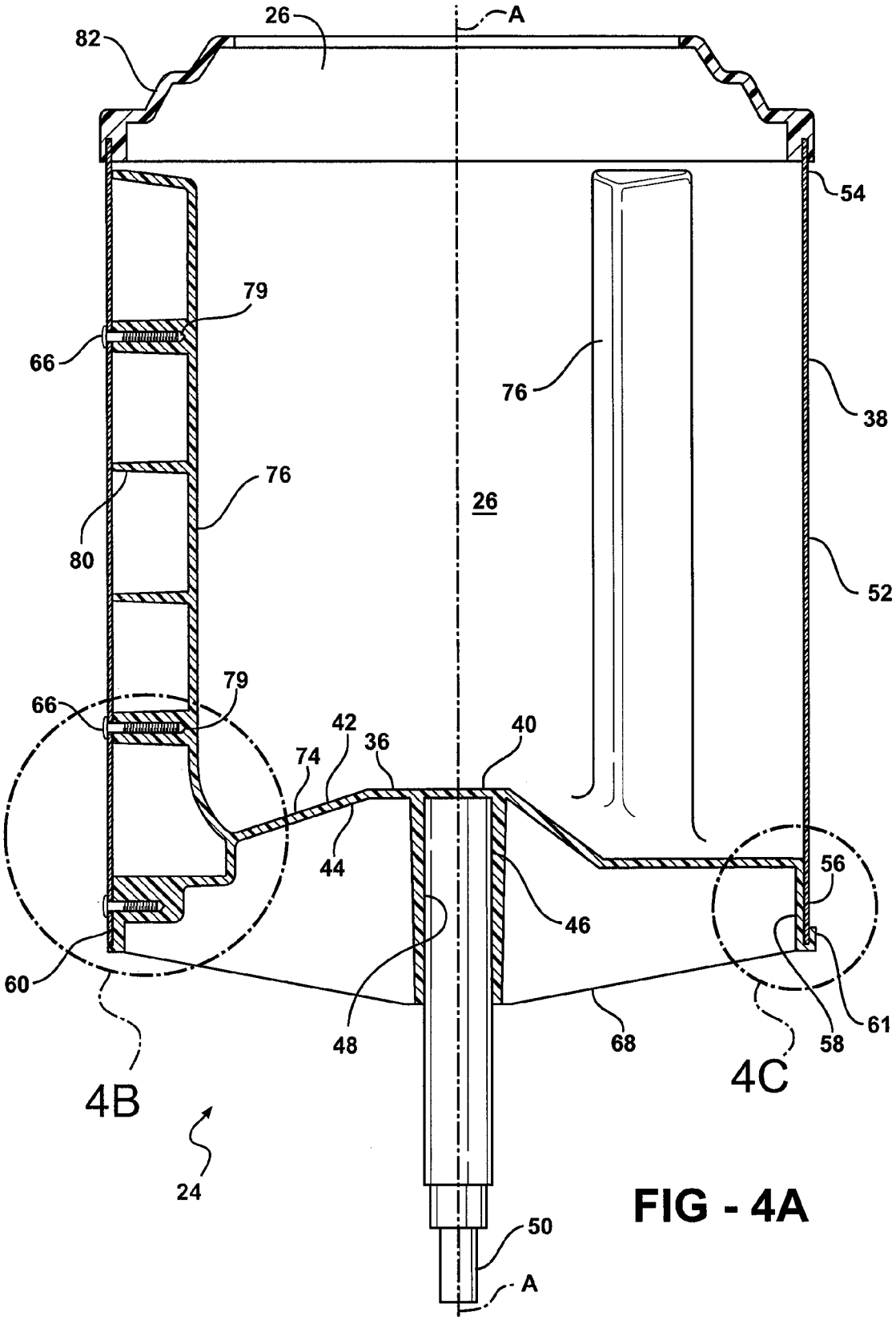
FIG. 4A is a cross-sectional view of the basket assembly along line 4 of FIG. 3.
Figure 4B:
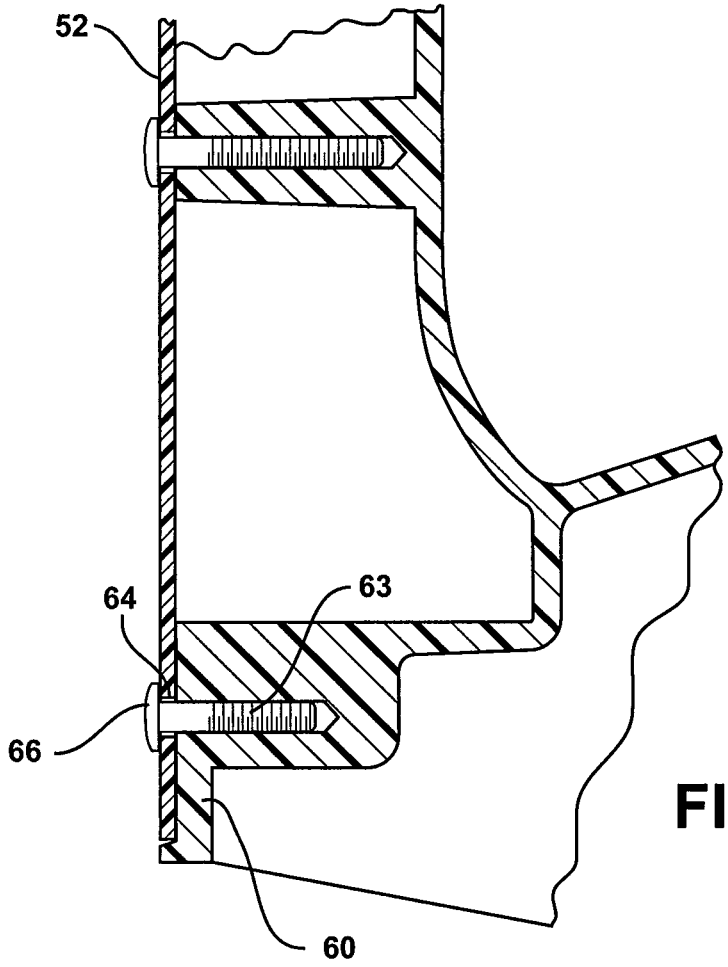
FIG. 4B is a magnified view of a portion of FIG. 4A.
Figure 4C:
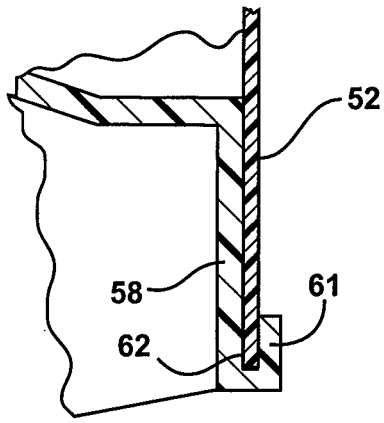
FIG. 4C is a magnified view of another portion of FIG. 4A.

The attachment portions 60 are connected to the basket 38 to transfer rotation from the support bracket 36 to the basket 38 when the motor rotates the support bracket 36. For example, a fastener 66 extends through one of the basket 38 and the attachment portion 60 and into the other of the basket 38 and the attachment portion 60, as shown in FIGS. 4A and 4B. In the embodiments shown in the Figures, each of the attachment portions 60 defines at least one hole 63 and the basket 38 defines at least one orifice 64 corresponding with the hole 63 in the attachment portion 60 such that orifice 64 can be aligned with the hole 63. The fastener 66 extends through orifice 64 and engages the corresponding hole 63. For example, the fastener 66 is a rivet or a threaded fastener such a screw.

The intermediate portions 58 typically abut the basket 38 for supporting the basket 38 to maintain the shape of the basket 38 when the basket 38 is rotated. Specifically, during rotation of the basket assembly 24, the laundry and the wash liquid exert centrifugal forces on the basket 38. The intermediate portions 58 limit or prevent the deformation of the basket 38 as the basket 38 is rotated.

The support bracket 36 typically covers the cavity 26 at the second end 56 of the basket 38 to support laundry that is loaded into the cavity 26. The attachment portions 60 and the intermediate portions 58 are at least partially disposed in the cavity 26 and are typically entirely disposed in the cavity 26. The attachment portions 60 extend toward the first end 54 of the basket 38 adjacent the basket 38.

The support bracket 36 has a plurality of fins 74 integrally extending from the front face 42 of the base 40 toward the first end 54 of the basket 38. The fins 74 are integral with the attachment portions 60 of the support bracket 36 for reinforcing the attachment portions 60. The fins 74 typically extend from the attachment portions 60 toward the axis A. The fins 74 also typically extend toward the axis A and intersect each other at the axis A.

The fins 74 support and reinforce the attachment portions 60 to increase the strength, stiffness, and durability of the support bracket 36 at the attachment portions 60. When the motor rotates the support bracket 36, the rotation is transferred from the support bracket 36 to the basket 38 at the attachment portions 60. This rotational transmission results in stresses at the attachment portions 60. The fins 74 reinforce the attachment portions 60 and distribute such stress to other parts of the base 40. In addition, the fins 74 assist in agitating the laundry and the wash liquid as the basket assembly 24 is rotated.

In the embodiment shown in FIGS. 1-4C, the support bracket 36 defines a channel 62 with the basket 38 partially disposed in the channel 62 at the second end 56 of the basket 38. Specifically, the support bracket 36 includes outer walls 61 spaced outwardly from the intermediate portions 58 relative to the axis A defining the channel 62 between the outer walls 61 and the intermediate portions 58.

The outer walls 61 extend along the intermediate portions 58 between the attachment portions 60. The outer walls 61 are spaced from each other radially relative to the axis A defining a space 86 between adjacent outer walls 61. The space 86 extends radially relative to the axis A and outwardly from the attachment portion 60 relative to the axis A. The basket 38 extends across the space 86 from one channel 62 to another channel 62. The basket 38 is typically connected to the attachment portion 60 at the space 86.

As shown in FIGS. 2-4A, the support bracket 36 includes arms 76 extending upwardly from the fins 74. The arms 76 are integral with the base 40 and the fins 74, i.e., the base 40 and the fins 74 are formed as a single continuous unit. It should be appreciated that the arms 76 and the base 40 and the fins 74 may be formed as separate pieces and subsequently attached to each other by, for example, adhesive, melt bonding, or mechanical fastening without departing from the nature of the present invention.

Each arm 76 defines at least one fastener hole 79 and the basket 38 defines at least one fastener orifice 78 corresponding with the fastener hole 79 in the arm 76 such that each fastener orifice 78 aligns with one of the fastener holes 79 when the basket 38 is mounted to the base 40. A fastener 66 extends through each of the fastener orifices 78 and engages the corresponding fastener hole 79. For example, the fastener 66 is a rivet or a threaded fastener such a screw. The arms 76 typically include reinforcing ribs 80.

The arms 76 reinforce the basket 38 to prevent deformation of the basket 38 as the basket assembly 24 is rotated. In addition, the arms 76 reinforce the attachment portions 60 by absorbing stress from the basket 38.

Figure 5B:
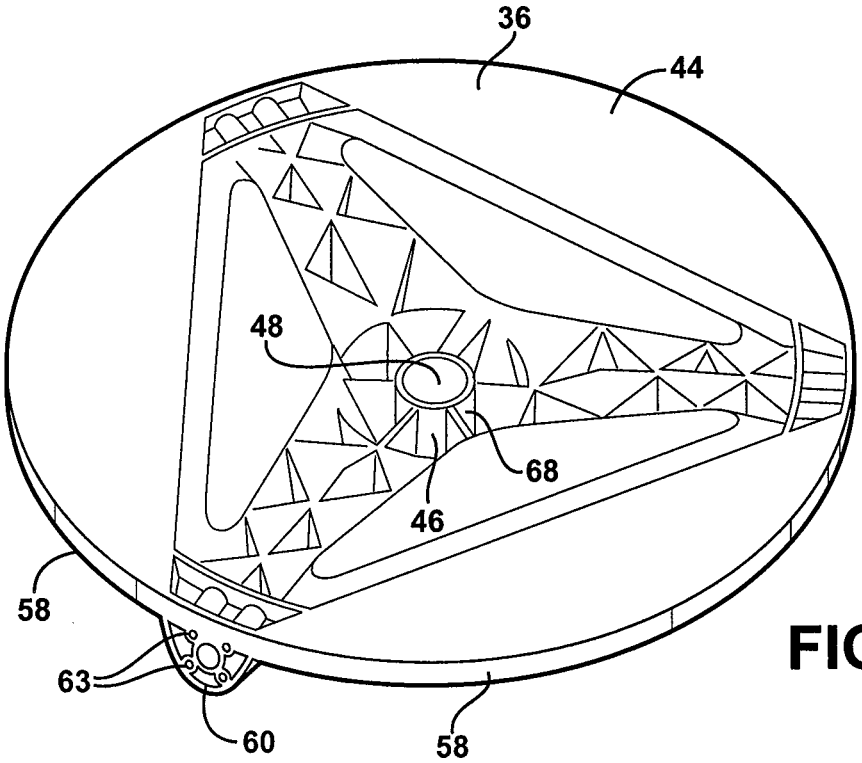
FIG. 5B is another perspective view of the support bracket shown in FIG. 5A.
Figure 6A:
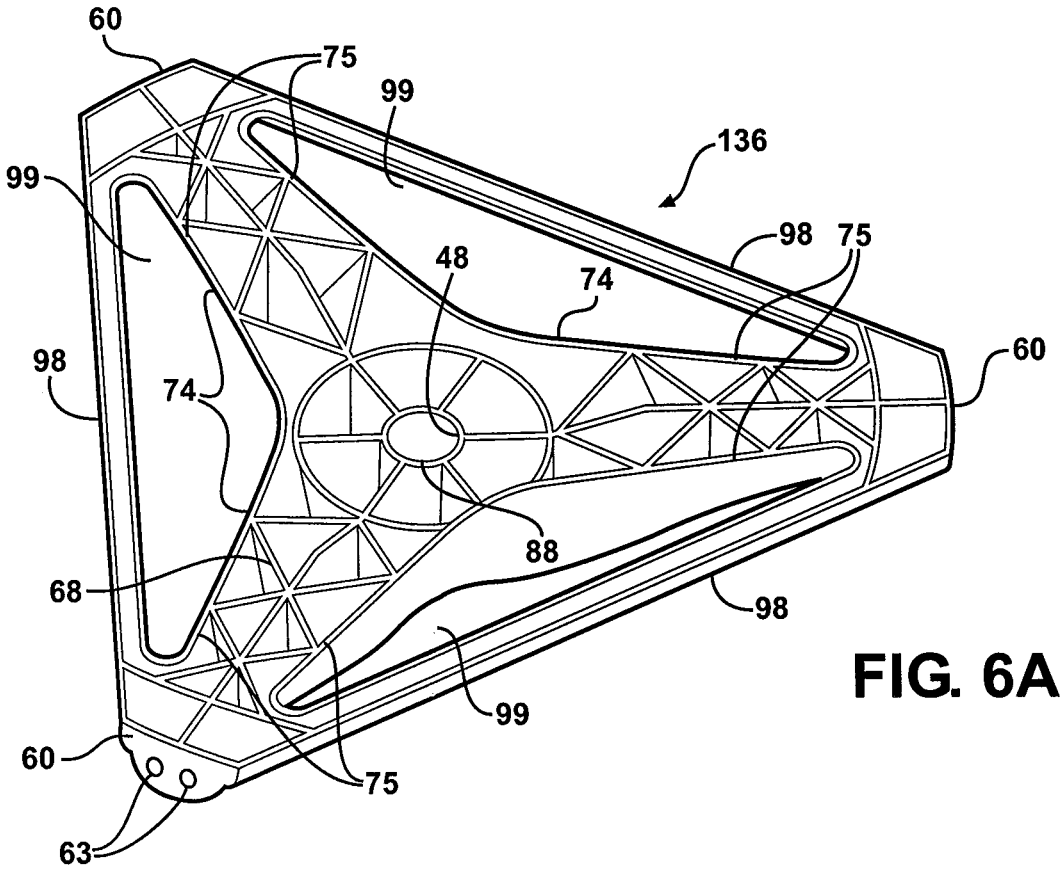
FIG. 6A is a perspective view of a support bracket of a second embodiment of the basket assembly.
Figure 6B:
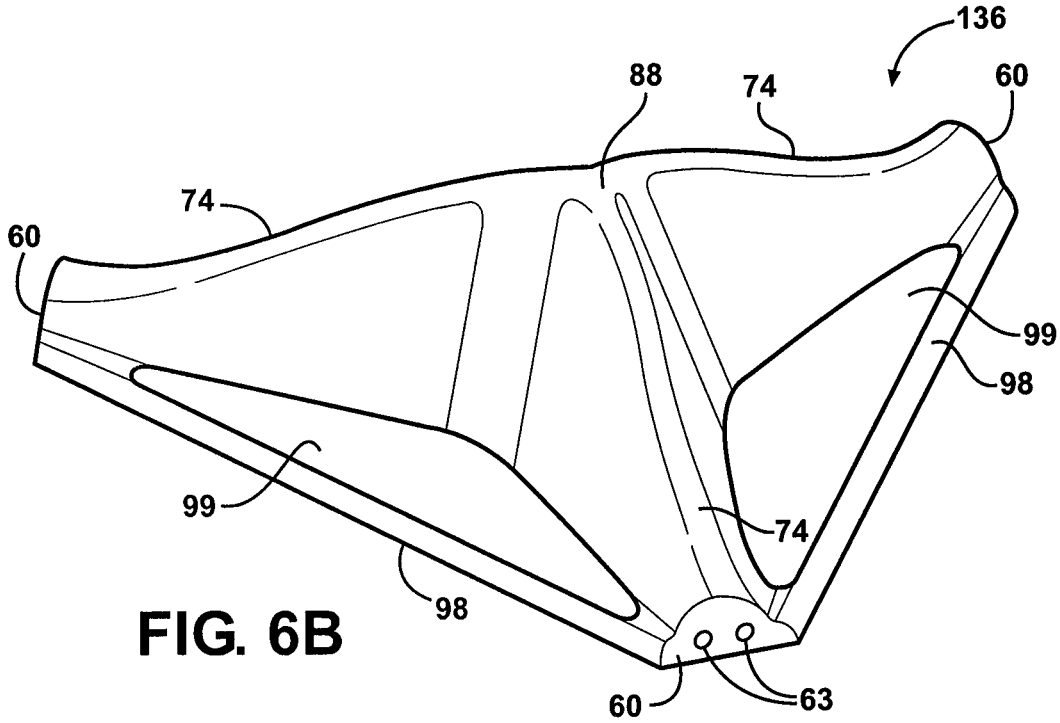
FIG. 6B is another perspective view of the support bracket of FIG. 6A.

As shown in FIGS. 5A-B, the support bracket 36 includes flanges 84 extending from the intermediate portions 58 toward the first end 54 of the basket 38 adjacent the basket 38.

The flanges 84 typically extend in alternating arrangement with the attachment portions 60 and extend from one attachment portion 60 to another attachment portion 60. The flanges 84 abut the basket 38 for reinforcing the basket 38 to prevent deformation of the basket 38. In addition, the flanges 84 reinforce the attachment portions 60.

In the configuration shown in FIGS. 5A-B, the arms 76 can be separate components from the support bracket 36 that are attached to the basket 38 in the cavity 26. Alternatively, the arms 76 can be integral with the basket 38. In either case, the arms 76 typically extend in a direction from the attachment portion 60 of the support bracket 36 toward the first end 54 of the basket 38.

The second embodiment of the basket assembly 124 is described in greater detail immediately below. As set forth above, the basket 138 of the basket assembly 124 includes an end wall 90 at the second end 56 of the basket 138. The end wall 90 extends transverse to the axis A and encloses the second end 56.

The support bracket 124 includes the hub 88 and the fins 74 are spaced from each other and extend radially from the hub 88. As set forth further below, the support bracket also includes a reinforcement rod 88 and reinforcement ribs 68. As set forth above, the support bracket 136 is formed of a thermoplastic, which is relatively inexpensive and lightweight. As set forth further below, not only is the support bracket 136 of the present invention advantageously inexpensive and lightweight, but the support bracket 136 is designed, e.g., with the fins 74, hub 88, reinforcement rods 98, reinforcement ribs 68, etc., to withstand the high loads that the support bracket 136 is subjected to during the transmission of rotation from the motor to the basket 138. In other words, the support bracket 136 is designed to withstand these high loads with an inexpensive, lightweight material and with less of that material.

The fins 74 extend from the hub 88 to the basket 138. The attachment portion 60 of each of the fins 74 is connected to the basket 138 at the second end 56 of the basket 138 to transmit rotation from the motor to the basket 138. Similar to the first embodiment, the second embodiment includes, for example, a fastener 66 extending through one of the basket 138 and the attachment portion 60 of the support bracket 124 and into the other of the basket 38 and the attachment portion 60.

The end wall 90 of the basket 138 defines a depression 92 and the support bracket 124 is disposed in the depression 92. As set forth in greater detail below, the support bracket 124 is coupled to the basket 138 in the depression 92 for transmitting rotation from the motor to the basket 138 and to minimize the size of the basket assembly 124.

As shown in FIGS. 7 and 8, the end wall 90 defines the depression 92 between the first end 54 and the second end 56 of the basket 138 such that the depression 92 extends from the second end 56 into the cavity 26 toward the first end 54. The cylindrical wall 52 of the basket 138 surrounds the end wall 90. The attachment portion 60 of each of the fins 74 abuts the cylindrical wall 52 of the basket 138 in the depression 92 of the end wall 90. As such, the support bracket 124 is recessed into the depression 92 to reduce the size of the basket assembly 124. The size of the cabinet 21 is limited by several constraints and the reduced size of the basket assembly 124 is advantageous for packaging the basket assembly 124 into the cabinet 21.

The hub 88 extends about the axis A. The hub 88 and the fins 74 extend into the depression 92 in the end wall 90 toward the first end 54. The hub 88 extends toward the first end 54 further than the fins 74, i.e., the hub 88 has a greater depth than the fins 74. The hub 88 of the support bracket 136 is designed with a greater depth than the fins 74 to reinforce the support bracket 136 about the drive rod 50. This reinforcement of the support bracket 136 about the drive rod 50 enables the support bracket 136 to withstand higher loads during the transmission of rotation from the motor to the basket 138.

The support bracket 124 includes a reinforcement rod 98 spaced from the hub 88. The reinforcement rod 98 extends from one of the fins 74 to another of the fins 74 for reinforcing the fins 74 when the support bracket 124 transmits rotation from the motor to the basket 138. Specifically, during rotation of the support bracket 124, the reinforcement rod 98 distributes localized stress in the fins 74 throughout the fins 74 and the reinforcement rod 98. One example of such localized stress is that at the intersection of the fins 74 and the hub 88. Because localized stresses in the fins 74 are distributed, the support bracket 124 can be formed from less material while withstanding higher loads during the transmission of rotation from the motor to the basket 138.

As shown in FIGS. 6A-8, the support bracket 124 typically includes three fins and three reinforcement rods. The fins 74 and reinforcement rods 98 are disposed in alternating relationship and each of the reinforcement rods 98 extend between two of the fins 74. However, it should be appreciated that the support bracket 124 can include any number of fins 74 and reinforcement rods 98 without departing from the nature of the present invention.

The reinforcement rod 98 typically extends from the attachment portion 60 of the one of the fins 74 to the attachment portion 60 of the other of the fins 74. Again, such a configuration reduces the moment about the fins 74 to distribute localized stress in the fins 74. This distribution of stress allows for a reduction of material in the support bracket 124 while maintaining durability under higher loads during the transmission of rotation from the motor to the basket 138.

The support bracket 124 defines a gap 99 between the hub 88, the fins 74, and the reinforcement rod 98. This configuration reduces the amount of material required to distribute localized stress as discussed above. Such a reduction of material advantageously decreases the material cost to produce the support bracket 24. Further, the configuration of the reinforcement rod 98 extending from one attachment portion 60 to another attachment portion 60 advantageously distributes localized stress while eliminating the need for material in the gap 99.

The reinforcement rod 98 is typically integral with the fins 74. Likewise, the hub 88 is typically integral with the fins 74. It should be appreciated that the reinforcement rod 98, the fins 74, and the hub 88 can be formed separately and subsequently attached to one another without departing from the nature of the present invention.

As shown in FIGS. 6B-8, each of the fins 74 includes opposing walls 75 and reinforcing ribs 68 extending between the opposing walls 75 for reinforcing the fins 74. These reinforcing ribs 68 reduce the amount of material while maintaining the ability of the fins 74 to transmit rotation from the motor to the basket 138.

The end wall 90 of the basket 138 can be integral with the cylindrical wall 52 of the basket 138, as shown in FIG. 7. For example, in the configuration shown in FIG. 7 the basket 138 is typically formed of the second thermoplastic as described above. Alternatively, the end wall 90 can be a separate component that is attached to the cylindrical wall 52, as shown in FIG. 8. For example, in the configuration shown in FIG. 8 the end wall 90 and the cylindrical wall 52 are typically formed of metal, such as stainless steel, and the end wall 90 and cylindrical wall 52 are crimped together.

The second embodiment of the basket assembly 124 includes arms 76 extending into the cavity 26 of the basket 138. The arms 76 can be integral with or attached to either the basket 138 or the support bracket 136. As shown in FIG. 7, for example, the arms 76 are integral with the basket 138. In such a configuration, the basket 138 is typically formed of the second thermoplastic. As shown in FIG. 8, for example, the arms 76 are separate components from the basket 138 and are attached to the basket 138 in the cavity 26. In either case, the arms 76 typically extend in a direction from the attachment portion 60 of the support bracket 136 toward the first end 54 of the basket 138.

The support bracket 136 can be spaced from the end wall 90 of the basket 138. Further, it should be appreciated that the shape of the depression need not correspond to the shape of the support bracket 136 as shown in FIGS. 7 and 8.

Alternatively, the fins 74 and the reinforcement rods 98 can abut the end wall 90 of the basket 138 in the depression 92. In such a configuration, the fins 74 and the reinforcement rods 98 transmit rotation from the motor to the basket 138. As such, this configuration distributes localized stress in the support bracket 136 and the basket 138 during the transmission of rotation from the motor to the basket 138. For example, the localized stress at the attachment portion 60 of each fin 74 is distributed along the reinforcement rods 98 and the fins 74 thereby reducing the amount of material required at that area to withstand such stress. In this configuration, the end wall 90 can be, for example, formed by molding the end wall 90 from the second thermoplastic, which typically results in more precise tolerances on the dimensions of the depression 92 thereby enabling a flush fit between the support bracket 136 and the basket 138 in the depression 92.

The invention has been described in an illustrative manner, and it is to be understood that the terminology which has been used is intended to be in the nature of words of description rather than of limitation. Obviously, many modifications and variations of the present invention are possible in light of the above teachings, and the invention may be practiced otherwise than as specifically described.

What is claimed is:

1. A basket assembly for a washing machine, said basket assembly comprising:

a basket having an axis and a first end and a second end spaced along said axis;

said basket defining a cavity at said first end of said basket for receiving laundry and having an end wall at said second end of said basket extending transverse to said axis with said end wall of said basket defining a depression; and a support bracket for transmitting rotation from a motor to said basket, said support bracket being disposed in said depression and being formed of polyalkylene terephthalate reinforced with glass fibers comprising 30%-50% glass content;

said support bracket including a hub and fins integral with said hub and spaced from each other extending radially from said hub, each of said fins having an attachment portion connected to said basket at said second end of said basket;

said fins and said reinforcement rod abutting said end wall of said basket in said depression for transmitting rotation from said support bracket to said basket;

said support bracket including a reinforcement rod spaced from said hub extending from said attachment portion of one of said fins to said attachment portion of another of said fins for reinforcing said fins when said support bracket transmits rotation from the motor to said basket;

said reinforcement rod being integral with said one of said fins and said another of said fins; and a fastener extending from said attachment portion of each of said fins, respectively, to said basket.

2. The basket assembly as set forth in claim 1 wherein said end wall defines said depression between said first end and said second end.

3. The basket assembly as set forth in claim 1 wherein said hub extends about said axis and said hub and said fins extend into said depression in said end wall toward said first end wherein said hub extends toward said first end further than said fins.

4. The basket assembly as set forth in claim 1 wherein said fins are further defined as three fins and said reinforcement rod is further defined as three reinforcement rods with said fins and reinforcement rods disposed in alternating relationship and each of said reinforcement rods extend between two of said fins.

5. The basket assembly as set forth in claim 1 further including a drive rod fixed to said hub of said support bracket for coupling said support bracket to the motor.

6. The basket assembly as set forth in claim 5 wherein said drive rod defines longitudinal grooves and circumferential grooves with said support bracket engaging said longitudinal grooves and said circumferential grooves for fixing said drive rod to said support bracket.

7. The basket assembly as set forth in claim 1 wherein said basket includes a cylindrical wall surrounding said end wall with said attachment portion of each of said fins abutting said cylindrical wall of said basket in said depression of said end wall.

8. The basket assembly as set forth in claim 1 wherein said basket includes a cylindrical wall surrounding said end wall with said cylindrical wall and said end wall being integral.

9. The basket assembly as set forth in claim 1 wherein said basket is formed of a second thermoplastic.

10. The basket assembly as set forth in claim 1 further including an arm extending from each of aid attachment portions, respectively, of said support bracket toward said second end of said basket.

11. The basket assembly as set forth in claim 10 wherein said arms are integral with said basket.

12. The basket assembly as set forth in claim 1 wherein each of said fins include opposing walls and reinforcing ribs extending between said opposing walls for reinforcing said fins.

* * * * *

UNITED STATES PATENT AND TRADEMARK OFFICE

CERTIFICATE OF CORRECTION

PATENT NO. : 8,650,918 B2
APPLICATION NO. : 12/344357
DATED : February 18, 2014
INVENTOR(S) : McMaster et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1187 days.

Signed and Sealed this
Eleventh Day of August, 2015

Michelle K. Lee

Michelle K. Lee
*Director of the United States Patent and Trademark Office*